United States Patent [19]

Quinn

[11] Patent Number: 5,063,998

[45] Date of Patent: Nov. 12, 1991

[54] FIRE EXTINGUISHER APPARATUS

[76] Inventor: Robert L. Quinn, 3505 75th St., N., St. Petersburg, Fla. 33710

[21] Appl. No.: 615,082

[22] Filed: Nov. 19, 1990

[51] Int. Cl.[5] ..... A62C 37/12

[52] U.S. Cl. ..... 169/65; 169/58; 169/59; 169/73

[58] Field of Search ..... 169/54, 56–59, 169/65, 73, 85, 89, 26, DIG. 3

[56] References Cited

U.S. PATENT DOCUMENTS

| | | | |
|---|---|---|---|
| 1,849,644 | 4/1930 | Stokes . | |
| 2,346,183 | 4/1944 | Paulus et al. | 169/73 |
| 2,557,120 | 6/1951 | Knoblock | 169/73 |
| 2,557,162 | 6/1951 | Wetzel et al. | 169/73 |
| 2,804,929 | 9/1957 | Plummer | 169/73 X |
| 2,808,114 | 10/1957 | Parker, Jr. et al. | 169/28 X |
| 3,040,815 | 6/1962 | Pambello | 169/57 |
| 3,538,939 | 11/1970 | Hoffman et al. | 137/264 |
| 3,584,688 | 6/1971 | Duncan et al. | 169/65 X |
| 3,613,793 | 10/1971 | Huthsing, Jr. | 169/26 |
| 3,820,607 | 6/1974 | Miley | 169/26 X |
| 3,958,595 | 5/1976 | Al et al. | 137/375 |
| 4,313,501 | 2/1982 | Eckert | 169/57 X |
| 4,756,839 | 6/1988 | Curzon | 252/2 |
| 4,813,487 | 3/1989 | Mikulec | 169/65 |
| 4,834,188 | 5/1989 | Silverman | 169/65 |
| 4,889,189 | 12/1989 | Roznieck | 169/73 |
| 4,979,572 | 12/1990 | Mikulec | 169/65 |

FOREIGN PATENT DOCUMENTS

| | | | |
|---|---|---|---|
| 803340 | 9/1936 | France | 169/73 |

*Primary Examiner*—Margaret A. Focarino
*Assistant Examiner*—James M. Kannofsky
*Attorney, Agent, or Firm*—Herbert W. Larson

[57] ABSTRACT

An automatically activated fire extinguishing apparatus mounted within a stove hood. The apparatus has a plastic bag liner enclosing a composition of fire extinguishing materials under pressure within a metal necked container. A pressure gauge housing having an interior channel containing an end of the plastic liner separates the necked container from an actuating header. A plastic nipple, located in a channel of the actuating header, closes an open end of an insert connected to the plastic liner. A fire sensitive device actuates a trigger which causes a cutting ram to sever the end of the nipple to permit exit of the fire extinguishing composition.

16 Claims, 6 Drawing Sheets

FIRE EXTINGUISHER APPARATUS

BACKGROUND OF THE INVENTION

1. Field of the Invention

This invention relates to an automatically operated fire extinguisher apparatus. More particularly, it refers to a fire extinguisher container enclosing a fire extinguishing composition within a plastic bag together with spray nozzles and elements for automatically spraying the composition on a fire.

2. Description of the Prior Art

Automatic fire extinguishing apparatus of various designs are set forth in U.S. Pat. Nos. 1,849,644; 3,040,815; 3,820,607; and 4,813,487. Typically, fire extinguishers contain aqueous solutions of potassium carbonate which eventually deteriorate the container and valves associated with this caustic material. Such deterioration reduces the life of the fire extinguisher and creates added cost. Attempts have been made to counteract this problem by preparing fire extinguishing compositions that are non-corrosive to metals as set forth in U.S. Pat. No. 4,756,839. However, these compositions are more expensive than simple potassium carbonate solutions which provide adequate fire extinguishing properties. A system is needed to employ potassium carbonate or other fire extinguishing compositions without damaging the containers and valves associated with the compositions during extended storage periods at elevated temperatures.

SUMMARY OF THE INVENTION

The present invention is the creation of a fire extinguishing system that prevents deterioration of metal containers, valves and gauges and can still use corrosive fire extinguishing materials within the system. The system employs a plastic bag liner not affected by corrosive solutions. The bag is retained within a pressurized standard necked metal container used for fire extinguishers. A neck of the bag liner is connected to a support sleeve within a pressure valve attached to the container at a first end and to an actuating header at a second end. The bag is kept open by the cylindrical support sleeve which is closed by a plastic nipple at one of its two open ends. The nipple is severed by a cutting ram in a channel within the actuating header when a trigger mechanism is activated by elements sensing a fire. Pressure within the metal container forces the fire extinguishing composition out through the actuating header and through its nozzles.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
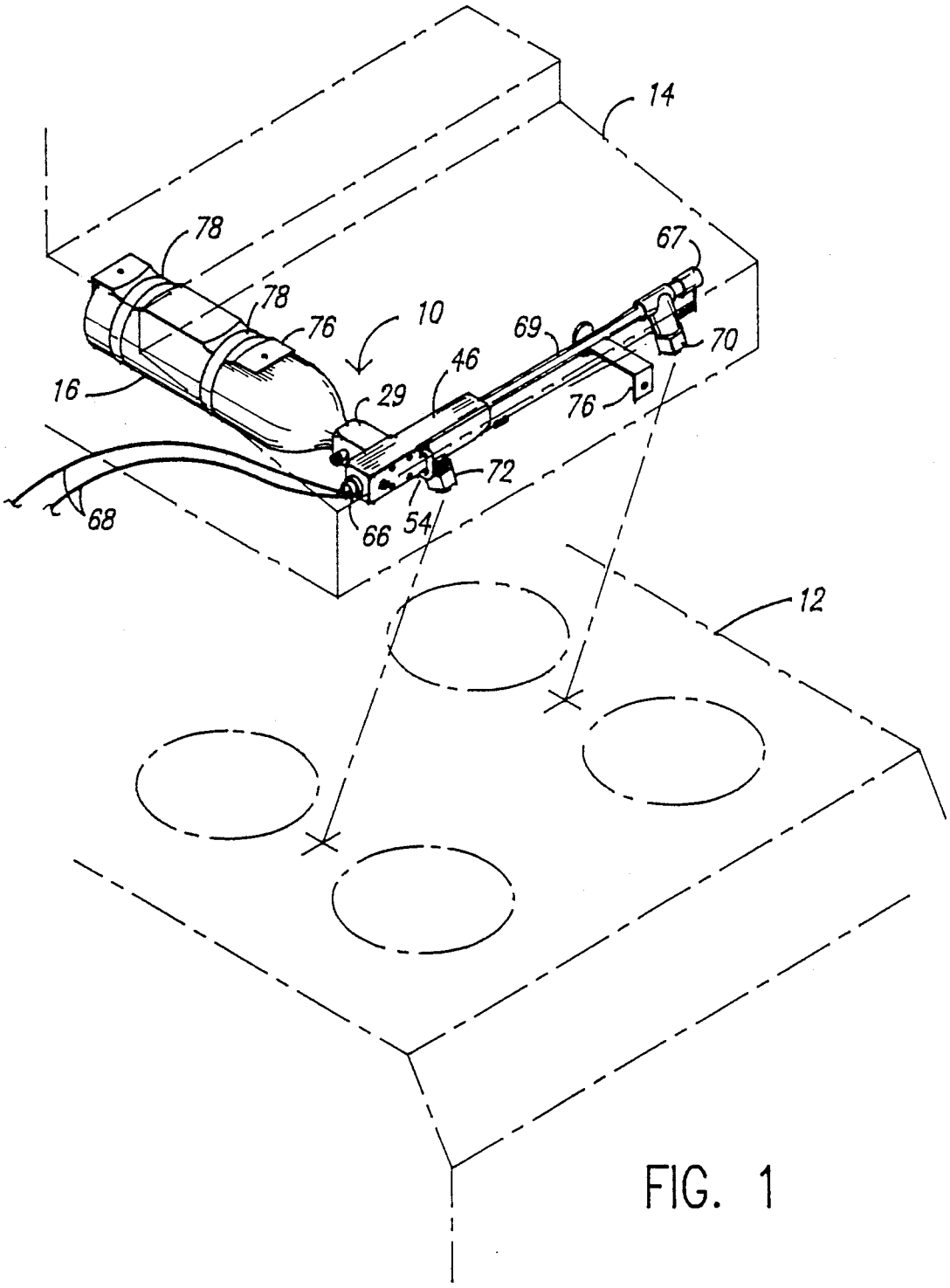
FIG. 1 is a perspective view of the fire extinguisher apparatus of this invention with its mounting in a stove hood over a stove shown in phantom.

Throughout the following detailed description, the same reference numerals refer to the same elements in all figures.

The fire extinguisher apparatus 10 is usually mounted above a stove 12, and is hidden within the stove hood 14 enclosure as seen in FIG. 1.

The fire extinguisher apparatus 10 has a necked container 16 usually made of metal such as steel or a heavy grade aluminum. The container 16 encloses a plastic bag 18 that is resistant to decomposition from the fire extinguishing composition 20 contained within the bag 18. The bag 18 can be a made from a polysulphone, or a nylon 6/6 two to six mil sheet polymer. A four mil sheet is preferred. The bag 18 is spaced apart by void 22 from the inner wall 24 of container 16. The fire extinguishing composition 20 can be a potassium carbonate and water mixture or a composition set forth in U.S. Pat. No. 4,756,839, incorporated herein by reference.

Figure 2:
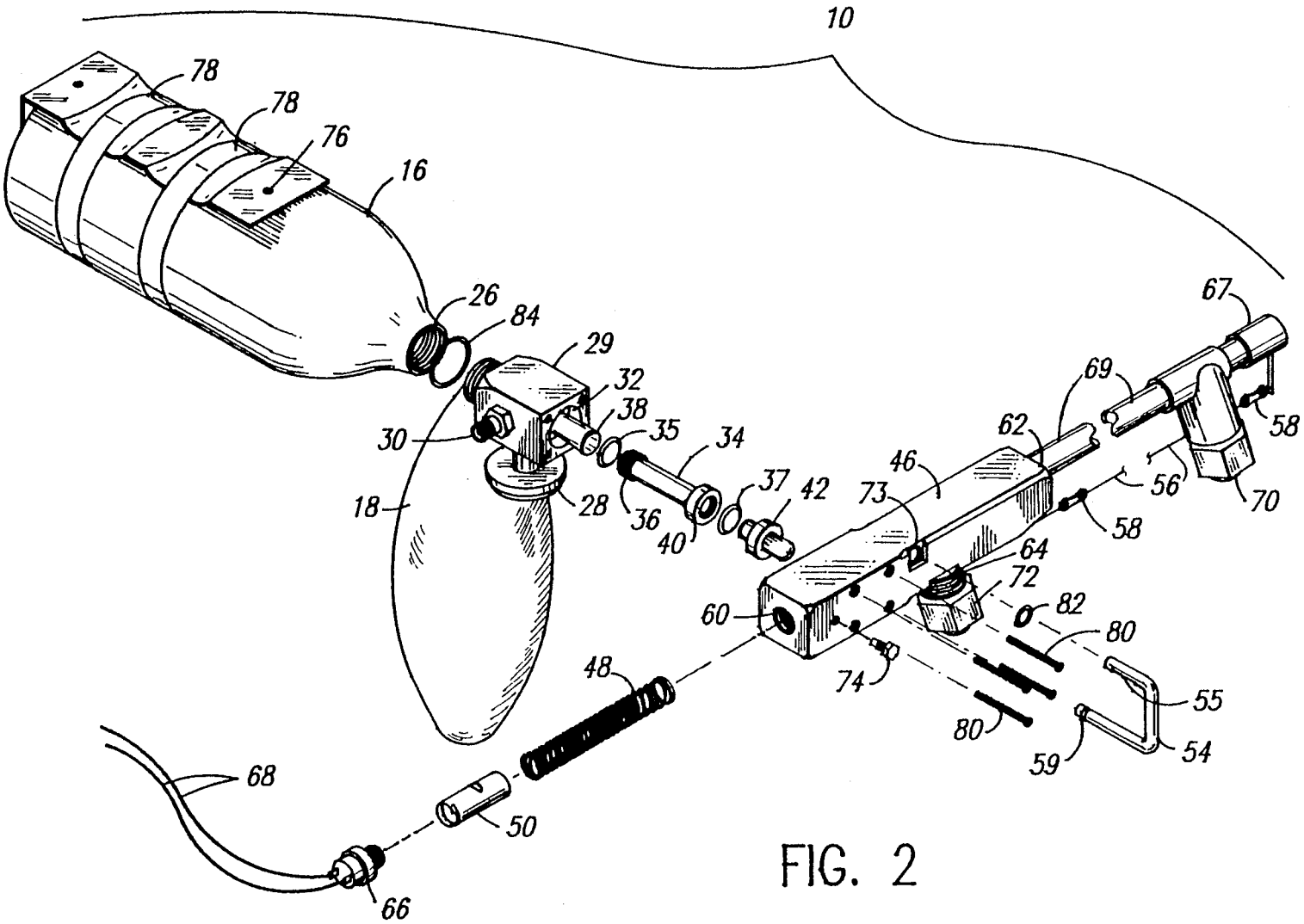
FIG. 2 is an exploded view in perspective of the various elements of the fire extinguisher apparatus.
Figure 3:
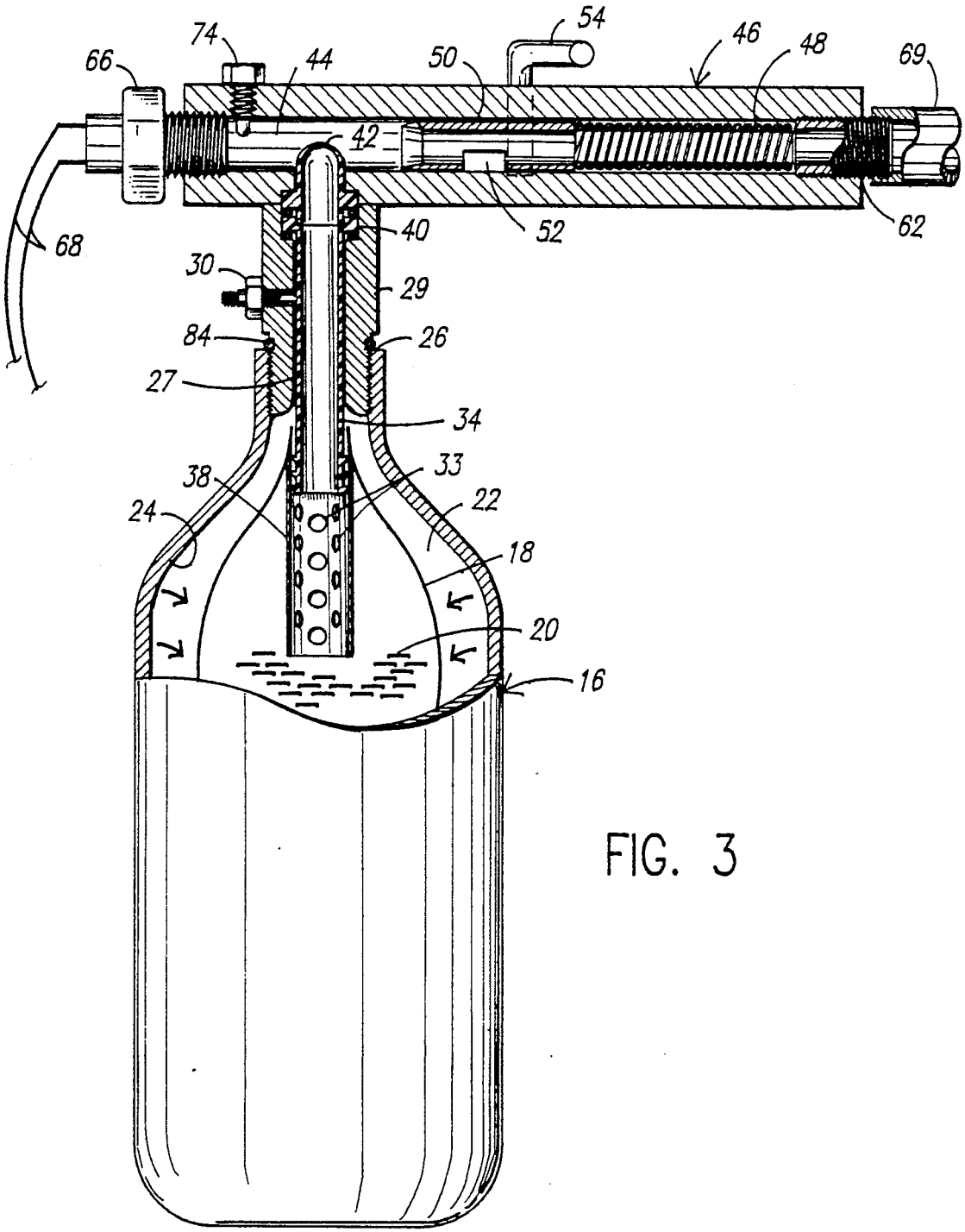
FIG. 3 is a bottom plan view in partial section of the fire extinguisher apparatus in its ready to use condition.
Figure 4:
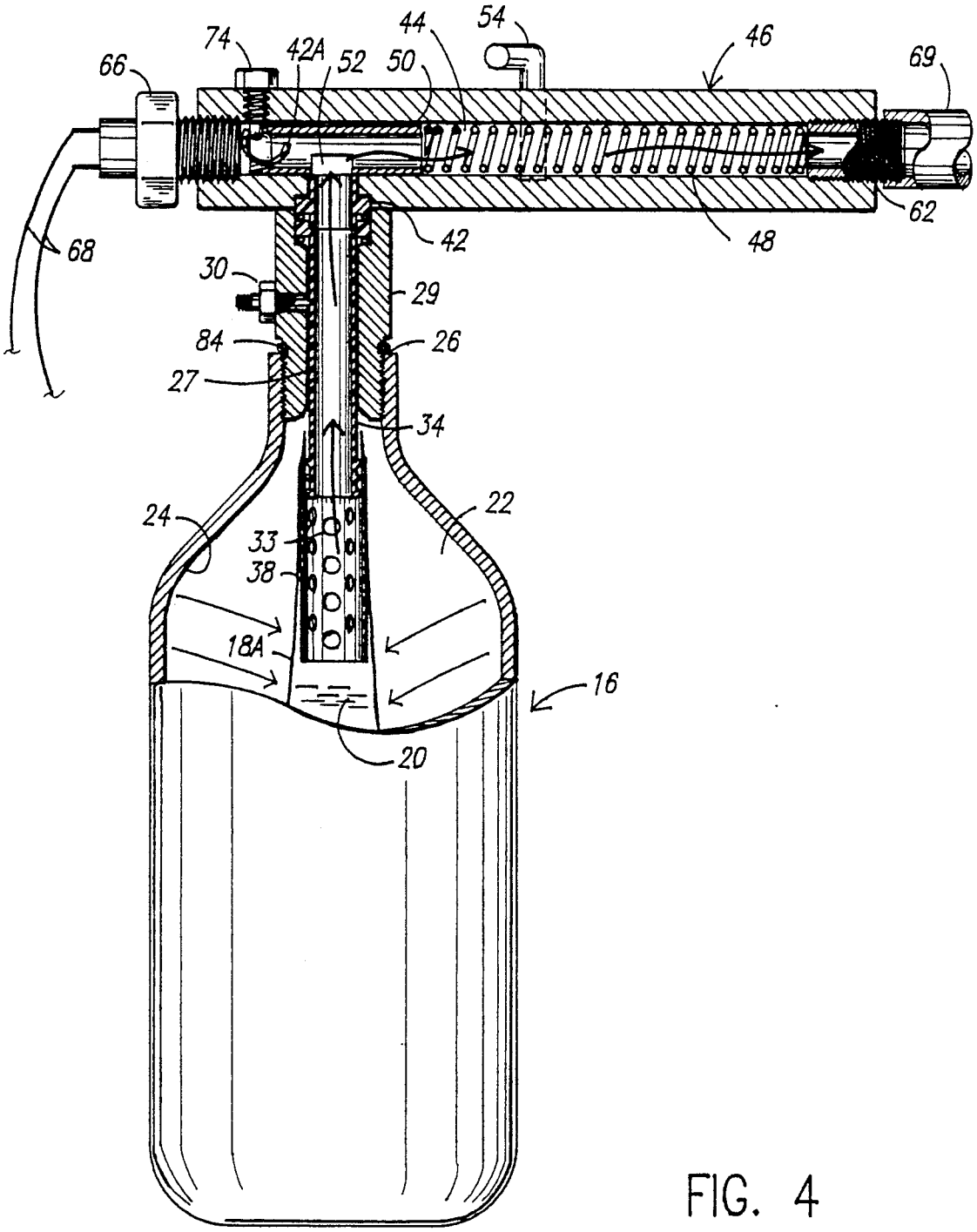
FIG. 4 is a bottom plan view in partial section of the fire extinguisher apparatus in its active use condition.
Figure 5:
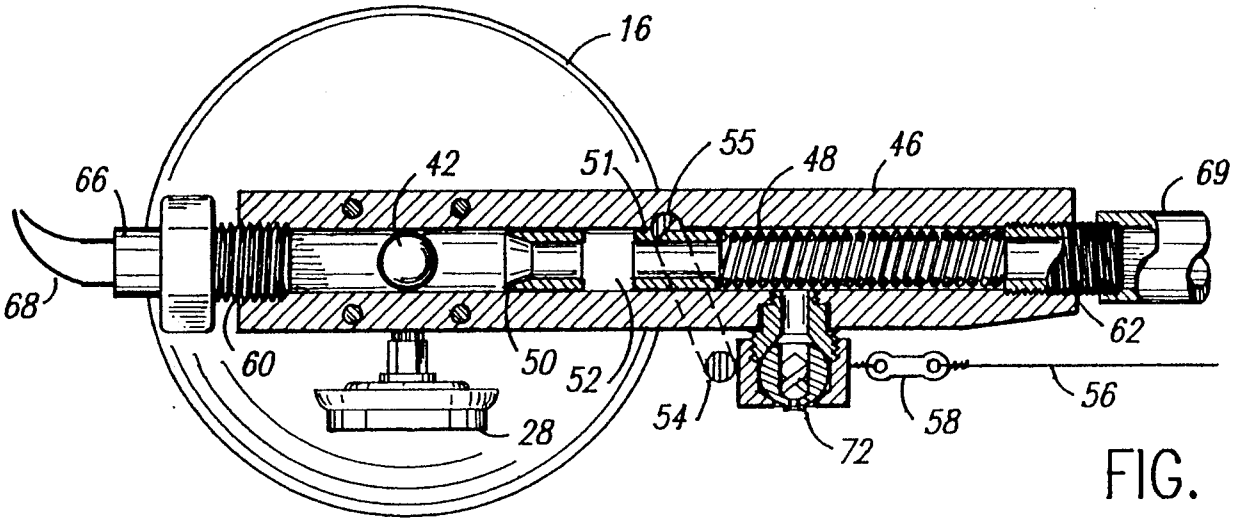
FIG. 5 is a detailed side section view of the activating mechanism prior to firing.
Figure 6:
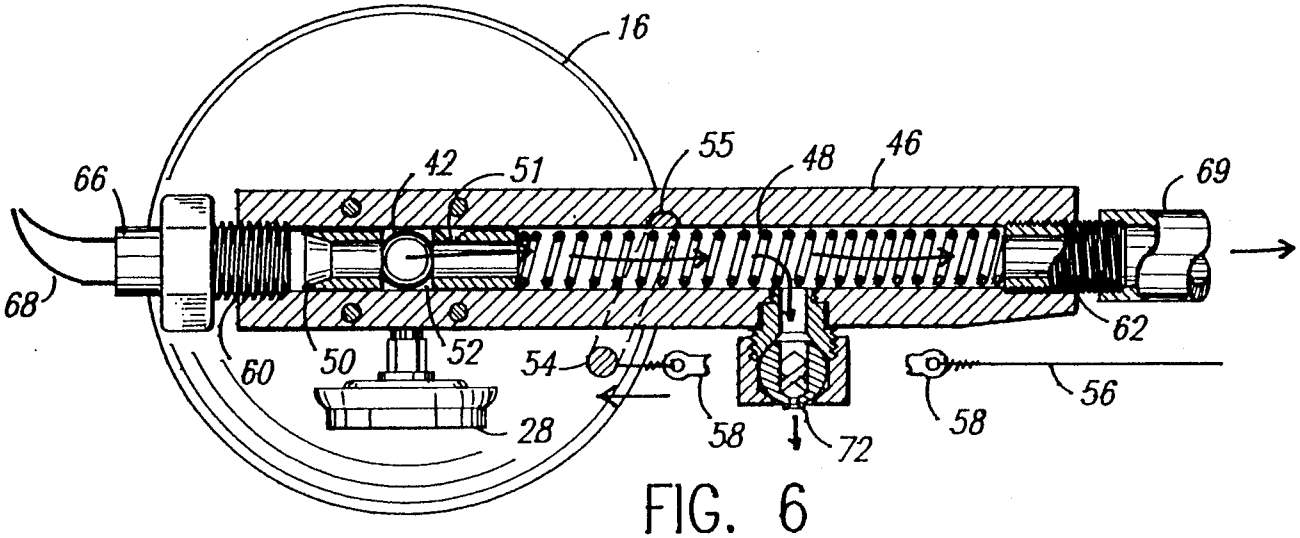
FIG. 6 is a detailed side section view of the activating mechanism after firing.

As seen in FIG. 2, the container 16 has an open end 26 into which is screwed a pressure gauge housing 29. Gasket 84 seats the housing 29 tightly. The pressure gauge 28 is integral with the bottom of housing 29 and a Schrader valve 30 is inserted through the side wall of housing 29. Valve 30 allows nitrogen gas or other gas to be pumped into the void 22 to put pressure on the fire extinguishing composition 20 within bag 18. About 64–120 psi of pressure is employed. About 100 psi is preferred. A channel 27 through housing 29 exits at opening 32. The top portion of bag 18 is inserted into channel 27 as seen in FIGS. 3 and 4 and a bag insert 38 made out of stiff plastic, such as DELRIN® acetal homopolymer, manufactured by E. I. du Pont & Company, is sonic welded or glued within the mouth of the plastic bag 18. The bag insert 38 is open at its bottom and top ends and has multiple side openings 33 to permit free flow of the fire extinguishing composition out of the bag when an opening is created in the system. Insert 38 supports the bag and acts as a straw during emission of composition 20. The fire extinguishing composition 20 exits the bag 18 through holes 33.

Figure 7:
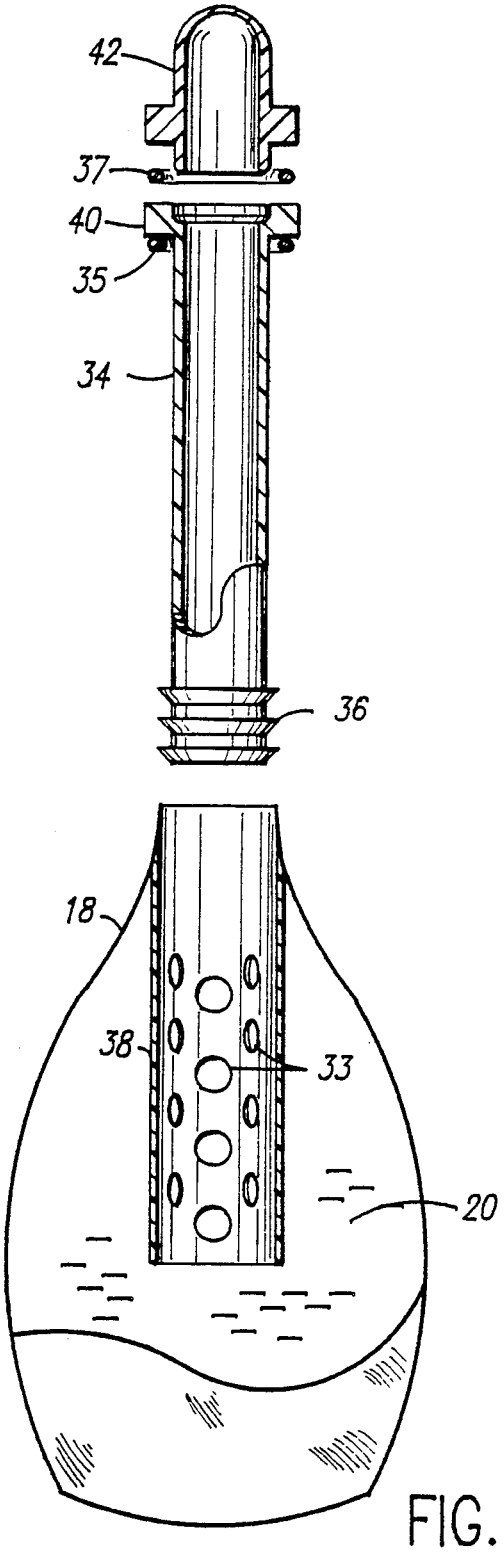
FIG. 7 is an enlarged exploded view of the plastic bag support sleeve and its attachment to the nipple and bag insert.
Figure 8:
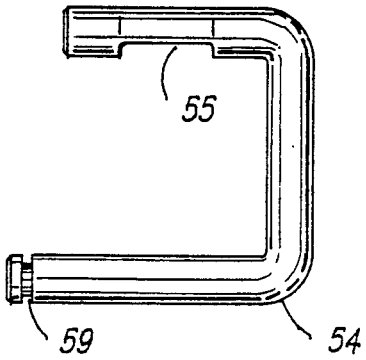
FIG. 8 is an enlarged side view of the trigger.
Figure 9:
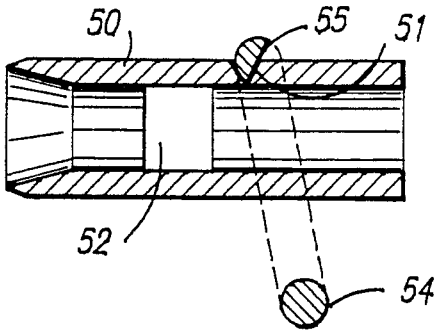
FIG. 9 is a section view through the trigger and cutting ram.

A support sleeve 34 having multiple concentric rings 36 at a first end fits into the top of insert 38. The second end 40 receives a nipple 42 made of a thin walled plastic material. This nipple is preferably made from forty-seven mil thick DELRIN®. The nipple 42 seals off the end 40 of the bag support sleeve 34 with the aid of O-ring 37 as seen in FIG. 7. O-ring 35 prevents leakage of the nitrogen gas.

The nipple 42 is located within a channel 44 of an actuating header 46. The actuating header 46 has a spring 48 mounted within channel 44 pressing upon a cutting ram 50. The cutting ram 50 has a transverse channel 52 which covers the nipple 42 opening when the nipple is cut. Channel 52 leads through the ram 50 to channel 44.

The trigger 54 is held in place by a monel wire 56 attached to a heat sensitive fusible link 58. The actuating header 46 is open at a first end 60 and a second end 62 as well as through a bottom opening 64. The first opening 60 is closed by a pressure switch 66 which electrically connects through wires 68 to a gas or electric shutoff mechanism, not shown. The pressure switch is set to actuate at ten pounds of pressure. A typical gas or electric power shut off system that can be used in conjunction with this invention is set forth in U.S. Pat. No. 4,813,487, incorporated herein by reference. The bottom opening 64 is open to the outside through nozzle 72. The second end 62 of the actuating header 46 is closed by a pipe 69 which can lead to an exit nozzle 70. End cap 67 closes pipe 69.

Upon reacting to a fire source, the heat of the fire will melt fusible link 58 and cause the monel wire 56 to be released. The link is usually made of indium. Thereupon, the monel wire 56 attached at 59 t the trigger 54 releases the trigger 54 engaged in opening 73. Trigger end 55 engaged in notch 51 of the cutting ram is then pulled out of notch 51. This action allows the ram 50 with its cutting edge to move within channel 44 and slice off the end of nipple 42. The cut end 42A is shown in FIG. 4. Approximately sixty-five pounds of pressure is exerted on ram 50 by spring 48. About six to eight pounds of pressure is exerted on point 59 of the trigger. A dog point screw 74 acts as a stop to prevent the ram 50 from extending out beyond the channel 44.

Upon slicing of nipple 42 the fire extinguishing material 20 within bag 18A, as seen in FIG. 4, is released by the pressure within container 16 and is pushed out through channels 52 and 44 up against the pressure switch 66 to actuate it and then out through the nozzles 70 and 72. If ram 50 fails to actuate, nipple 42 will still rupture at 325° to 330° F. Nozzles 70 and 72 are directed toward the bottom of a potential fire source such as a stove 12 so that upon actuation the fire is quickly suppressed. Typical nozzles that can be used with this invention are set forth in U.S. Pat. No. 4,813,487, incorporated herein by reference.

In its preferred embodiment the container 16 is mounted on an inner surface of a hood 14 by mounting brackets 76 held in place by straps 78. Screws 80 hold the actuating housing 46 in engagement with the gauge housing 29. An O-ring 82 is placed in bore 73 to engage with one end 55 of the trigger mechanism 54 for a fluid seal within the actuator housing 46.

Using the apparatus of this invention, the fire extinguishing composition does not touch a metal surface during storage and therefore will not decompose container 16, valve housing 29 or the pressure valve 28.

Having thus described the invention, what is claimed and desired to be secured by Letters Patent is:

1. An automatic fire extinguisher apparatus with a necked container open at one end, enclosing a fire extinguishing composition, the apparatus comprising in addition, (a) a soft plastic bag having a necked down opening, the bag resistant to decomposition from the fire extinguishing composition, the bag retained within the container and storing the fire extinguishing composition away from contact with an inner wall of the container, (b) a pressure gauge housing secured to the open end of the container, the gauge housing engaged to the container at a first end and at a second end to an actuating header, the pressure gauge housing having a pressure gauge and a means for inserting a pressurized gas into the container integral with the housing, (c) the pressure gauge housing having an inner channel containing a device for supporting the opening in the bag at a first end and a nipple at a second end, the nipple mounted within an interior channel of the actuating header, the actuating header having a spring actuated cutting ram restrained within the interior channel, the interior channel leading to at least one exterior nozzle, (d) a trigger element mounted on the exterior of the actuating header and engaging through a bore into the interior of the header with the cutting ram to prevent its movement, (e) a heat sensitive link for retaining the trigger element in a locked position, the link separating upon detection of heat from a fire to release the trigger element and disengage it from the cutting device, whereby the cutting device slices through the nipple to allow the fire extinguishing composition to exit the container and the nozzle to spray on the fire to suppress the fire.

2. The automatic fire extinguisher apparatus according to claim 1 wherein the soft plastic bag is made from a polysulphone polymer.

3. The automatic fire extinguisher apparatus according to claim 1 wherein the soft plastic bag is made from a nylon polymer.

4. The automatic fire extinguisher apparatus according to claim 1 wherein the means for inserting a pressurized gas is a Schrader valve and the gas is nitrogen.

5. The automatic fire extinguisher apparatus according to claim 1 wherein the apparatus is mounted within a hood of a stove and the nozzle is directed downward towards the stove.

6. The automatic fire extinguisher apparatus according to claim 1, wherein the device for supporting the opening in the bag is a cylindrical element open at both ends and having side holes, the device being sonic welded to the interior of the bag opening.

7. The automatic fire extinguisher apparatus according to claim 1 wherein a pressure switch cap seals a first end of the interior channel and an end cap seals a second end.

8. An automatic fire extinguisher apparatus with a container open at one end enclosing a fire extinguishing composition, the apparatus comprising, in addition, (a) a plastic bag open at one end, the bag resistant to decomposition from the fire extinguishing composition, the bag storing the fire extinguishing composition away from contact with an inner wall of the container, (b) a pressure gauge housing secured to the open end of the container at a first end and secured to an actuating header at a second end, the pressure gauge housing having an interior channel containing a device for supporting the bag opening, the device supporting the bag having a nipple at a position distal from the container, the nipple mounted within an interior channel of the actuating header, the actuating header having a spring actuated cutting ram restrained within the interior channel, the interior channel open to at least one exterior nozzle and sealed at its ends, (c) a trigger element mounted on the exterior of the actuating header and engaging, through a bore into the interior of the header, with the cutting device to prevent its movement, (d) a heat sensitive link for retaining the trigger element in a locked position, the link separating upon detection of heat from a fire to release the trigger element and disengage it from the cutting device, whereby the cutting device slices through the nipple to allow the fire extinguishing composition to exit the container through the nozzle.

9. The automatic fire extinguisher apparatus of claim 8 wherein the plastic bag is made from a polysulphone polymer.

10. The automatic fire extinguisher apparatus of claim 8 wherein the plastic bag is made from a nylon polymer.

11. The automatic fire extinguisher apparatus of claim 8 wherein the bag contains an aqueous mixture of potassium carbonate.

12. The automatic fire extinguisher apparatus of claim 8 wherein the apparatus is mounted within a hood.

13. The automatic fire extinguisher apparatus of claim 8 wherein the trigger element is a U-shaped metal structure retained in position by a wire attached to the fusible link.

14. The automatic fire extinguisher apparatus of claim 8 wherein the nipple ruptures upon exposure to 325° to 330° F.

15. The automatic fire extinguisher apparatus of claim 8 wherein the device supporting the bag is a cylindrical first tube, open at both ends and welded to an inner surface of the bag, and a cylindrical second tube engaged to the first tube at a first end and to the nipple at a second end.

16. The automatic fire extinguisher apparatus of claim 15 wherein the nipple is sealed to the second tube by an O-ring.

* * * * *